United States Patent [19]

Vause

[11] 3,944,808

[45] Mar. 16, 1976

[54] LAMP MOUNTING ASSEMBLY

[75] Inventor: Arthur Samuel Vause, London, England

[73] Assignee: Thorn Electrical Industries Limited, London, England

[22] Filed: Sept. 3, 1974

[21] Appl. No.: 502,883

[30] Foreign Application Priority Data

Sept. 7, 1973 United Kingdom ..... 42256/73

[52] U.S. Cl. ..... 240/52 R; 240/52.1; 339/50 R

[51] Int. Cl.[2] ..... F21V 21/00

[58] Field of Search ..... 240/52 R, 52.1, 73 QD, 240/41.35 R, 415 B, 11.4 R; 313/113; 339/50 R

[56] References Cited

UNITED STATES PATENTS

| | | | |
|---|---|---|---|
| 3,360,765 | 12/1967 | Strange et al. | 240/11.4 R |
| 3,571,587 | 3/1971 | Hilzen | 240/11.4 R |
| 3,621,232 | 11/1971 | Hough et al. | 240/41.35 R |

FOREIGN PATENTS OR APPLICATIONS

| | | | |
|---|---|---|---|
| 1,055,631 | 1/1967 | United Kingdom | 240/52 R |
| 1,056,742 | 1/1967 | United Kingdom | 240/52 R |
| 1,055,542 | 1/1967 | United Kingdom | 240/52 R |

*Primary Examiner*—R. L. Moses

*Attorney, Agent, or Firm*—Robert F. O'Connell

[57] ABSTRACT

A lighting unit has a lamp supported in position relative to a reflector by means of a support including a holder which clasps an end seal of the lamp envelope or capping box fitted to the end seal, a co-operating rib and groove in the holder and end seal or in the holder and the capping box serving to locate the lamp against axial movement. For a double-ended lamp two holders are provided on a common support.

4 Claims, 2 Drawing Figures

LAMP MOUNTING ASSEMBLY

The present invention relates to improvements in the construction of lighting units such as sealed beam units.

In any lighting unit which is to give a defined pattern of illumination, lenses and/or reflectors having specific optical properties are required. The required illumination, however, is only attained if the actual source of light is correctly positioned relative to the lenses and/or reflectors of the unit. It may, for instance, frequently be necessary to locate an internal reference point, e.g. the centre of a filament or the centre of an arc discharge path in coincidence with a focal point of a reflector. The aim of this invention is to provide a simply constructed support with the aid of which a lamp can be maintained precisely at a given position in a lighting unit. The lighting unit can be of the sealed beam type, such as an automobile headlamp.

According to the present invention, there is provided a lighting unit including a lamp having an envelope closed by an end seal, a reflector, and a support mounting the lamp in a predetermined position with respect to the reflector, characterised in that the support comprises a holder which clasps the end seal of the lamp or a capping box secured thereto, the holder and the end seal or the holder and the capping box having an interlocking rib and groove extending transverse to the axis of the lamp to locate the lamp against axial displacement and being formed with abutment surfaces to locate the lamp against displacement in directions transverse to the axis.

Depending upon the nature of the lighting unit, the holder can be constructed for releasable or permanent retention of the lamp. Where the unit is of the sealed beam type, the holder would normally provide permanent retention of the lamp.

In one preferred embodiment of the invention, the support is an inverted cup having a given height, the holder being centrally disposed in the base of the cup and preferably integral therewith. The holder is a hollow clasp member which embraces and grips the seal end of the lamp. The clasp member has opposed recesses for mating with correspondingly shaped ribs on the seal end of the lamp, and is so designed that the said seal end snaps into engagement therewith.

A second embodiment is designed particularly for a unit using a double ended lamp. In this embodiment, the support has a pair of holders which are spaced apart according to the distance between the two seals at the opposite ends of the lamp. The holders are carried upon opposite ends of a yoke forming part of the support.

The lamp support can be secured in any convenient manner to any convenient part of the unit. Thus, in the manufacture of a sealed beam unit, the support can be fixed to the reflector in readiness for subsequent attachment of the lamp at a later stage in the manufacturing process.

Figure 1:
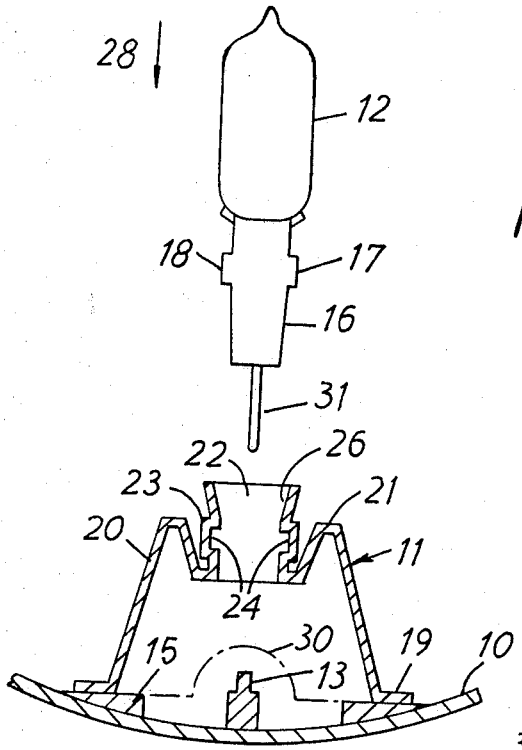
Figure 2:
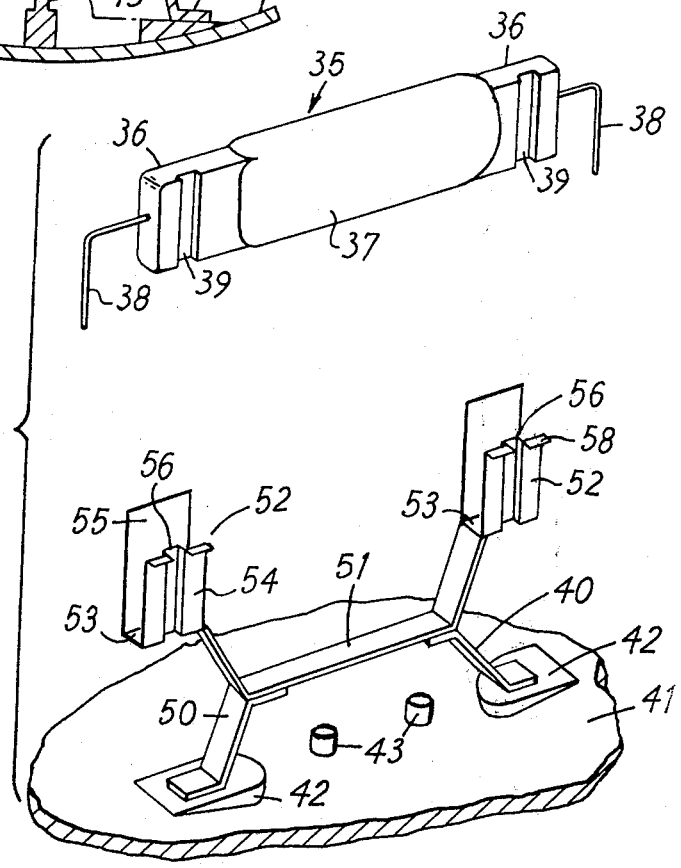

The present invention will now be described by way of example with reference to the accompanying drawings, in which:

FIG. 1 illustrates in exploded form an assembly embodying the invention, showing parts in cross-section, and FIG. 2 is an illustration similar to FIG. 1, showing another embodiment of the invention.

FIG. 1 shows part of a lighting unit having a curved reflector 10, a lamp support 11 and a lamp 12. The arrangement is particularly adapted for use in sealed beam units, for instance for automobile lighting. However, the support 11 can be fitted otherwise than to a reflector, and is designed to hold the lamp 12 at a known position relative to a reflector, lens and other optical components of a lighting unit. The unit is not necessarily a sealed beam unit.

The reflector 10 is, for the purpose of convenience, considered as part of a sealed beam unit. It has a plurality of terminal posts 13 for transferring current from an external electrical supply to the lamp 12. The posts 13 are not shown in detail since they are well known and can be of any conventional type. A circular ledge 15 formed in the inner or reflecting surface of the reflector 10 provides a foundation for the lamp support 11. The ledge 15 defines a planar surface to which the support 11 is secured.

The lamp 12 is of a standard, single-ended design, having one or more filaments. It can be of the H4, tungster. halogen type. Each filament is at a known position relative to a pinch seal at the lower end of the lamp. The pinch seal is not visible in the drawing, since it is contained within a capping box 16 fabricated from sheet metal. The capping box 16 engages ridges or depressions formed in the surface of the pinch seal, so as to be secured rigidly and immovably. Two projecting ribs 17, 18 project from opposed faces of the capping box 16. The ribs 17, 18 are a set distance from the or a filament of the lamp 12 and form part of a keying arrangement by means of which the lamp 12 is interlocked with the lamp support 11.

The lamp support 11 takes the form of an inverted cup having a flange or rim 19 which seats upon and is bonded to the ledge 15. The support cup is circular in plan and has a frusto-conical side wall 20 reaching from the flanged rim 19 to a base portion 21 of the cup. Centrally within the base portion 21 is an opening 22 for receiving the end seal of the lamp. Surrounding the opening 22 is a hollow clasp member 23 or tubular sleeve for embracing and gripping the capping box 16 on the lamp seal. The clasp member 23 is formed internally with recesses 24 in opposed faces. The recesses 24 conform in shape to the ribs 17, 18 on the capping box 16 and thus form the other part of the keying arrangement mentioned above. The clasp member is formed with a mouth having flared lips 26.

The inverted lamp support cup 11 can be moulded from a plastics material, and has considerable rigidity. Nevertheless the cup 11 has sufficient resilience in the region of the clasp member 23 for the capping box 16 to snap into engagement with the clasp member. When the lamp 12 is pushed in the direction of the arrow 28 and the ribs 17, 18 engage the flared lips, the lips 26 of the clasp member 23 are caused to spread open sufficiently for the ribs 17, 18 to enter the recesses 24. The clasp member 23 then snaps back owing to its resilience, imprisoning the ribs 17, 18 in the recesses 24. The dimensions of the support cup 11 are chosen such that the or a filament of the lamp 12 coincides with a focal point of the reflector 10.

It should be noted that use of the capping box 16 may be rendered unnecessary if the lamp 12 is produced with a pinch seal of profile similar to that described for the capping box (i.e. with ribs 17, 18 moulded into the pinch seal and having a determined relationship to the or a filament of the lamp).

The lamp support 11 could be fabricated from a ductile, resilient sheet metal, and does not have to be a generally cup-shpaed object. If desired, the support 11 could consist of two legs shaped in accordance with the outline shown in FIG. 1. Movement of the lamp 12 into engagement with the support would be accompanied by momentary bending of the legs as the ribs 17, 18 approach the recesses 24. If the support 11 is made in this manner, one or other or both of the two opposed elements of the clasp 23 should include flanges or tangs to prevent the lamp 12 slipping sideways. Such flanges or tangs could be bent into position against the capping box 16 after insertion of the lamp 12.

Where the support 11 is in the form of a cup, portions of its periphery are cut away to define cut-outs 30. The cut-outs 30 facilitate the connection of lead-out conductors 31 to the posts 13. The connections can be effected by soldering, crimping or the like.

The flanged rim 19 of support 11 can be secured to the ledge 15 in a variety of ways. For example, epoxy resin adhesive could be employed. If both the support 11 and the reflector 10 are metallic members, they can be fastened together by soldering, welding or brazing.

The construction shown in exploded perspective in FIG. 2 is for lighting units which use double ended lamps. The lamp 35 is of a substantially standard design and has two pinch seals 36 at opposite ends of its envelope 37. A lead-out conductor 38 passes through each pinch seal 36, the conductors 38 being connected inside the envelope 37 to a single, axially disposed filament, not shown. It will be seen that the pinch seals 36 are flat and substantially rectangular, and each is provided with a transverse groove or recess 39.

A lamp support 40 is carried by a curved reflector 41. The reflector has two protrusions 42 providing foundations to which the support 40 is secured, and terminals 43 for connection to the lead-out conductors 38.

The support 40 comprises a cradle or stand fabricated in this instance from metal strip and having legs 50 provided with feet which are bonded in any convenient way to the reflector protrusions 42. The top ends of the legs 50 bear a two-armed yoke 51, whose two arms terminate in holders 52 for the pinch seals 36.

Each holder 52 is bent from sheet metal and comprises a platform 53, which supports the lower edge of the associated seal 36, and two upstanding side portions 54, 55. The side portions 54, 55 are spaced apart by a distance equal to the thickness of each seal 36. The side portion 54 has vertical folds defining an inwardly directed projection or key 56 for mating with the groove or recess 39 in the associated seal. The side portion 55 is of such a height as to be capable of being folded over the top edge of the seal 36. When the side portion 55 is folded over, it can be spot welded or crimped to flanges 58 on the upstanding portion 54.

It will be appreciated that the lamp 35 is securely held against movement by the holders 52. The interengaging keys 56 and recesses 39 prevent movement of the lamp 35 in its axial or lengthwise direction. The folded-over side portion 55 prevents lifting of the mounted lamp from the support 40.

The lamp 35 has to be supported at a known position relative to the reflector 41. It is common to arrange that its central filament axis intersects the focal point of the reflector 41. The dimensions of the support 40 are selected accordingly.

Whilst the holders 52 are designed primarily for permanently mounting the lamp 35, they could be still used where the lamp 35 is to be detachable to allow replacement thereof. The folded-over side portion 55 would not, in that case, be soldered or welded to the flanges 58. Thus, the support 40 could be employed in a demountable lighting unit, like the support 11 shown in FIG. 1. It will be recognized that attaching the supports 11, 40 directly to a reflector 10, 41 is merely a matter of convenience. Clearly, the supports can be attached to other parts of a lighting unit, for example the inside of a housing of a demountable unit. It will also be recognized that throughout the applications and constructional examples described, the light source may take the form of an arc discharge in place of the filament examples quoted.

It will further be apparent that the system described can be readily adapted to provide simple focal mounting of two or more lamps in predetermined relationship to each other and to one or more reflectors.

I claim:

1. A lighting unit comprising a lamp having an envelope with a seal structure at one end of the envelope, a reflector, and a support mounting the lamp in a predetermined position with respect to the reflector, said support comprising a holder clasping the said seal structure, said holder and said seal structure having interlocking rib and groove means extending transverse to the axis of the lamp and locating the lamp against axial displacement and said holder and said seal structure being formed with abutment surfaces to locate the lamp against displacement in directions transverse to the axis, said reflector having integral protrusions on the reflecting surface to which the support is secured to establish the said predetermined position.

2. A lighting unit as claimed in claim 1 wherein said seal structure includes a capping box, said capping box comprising at least one rib of said rib and groove means.

3. A lighting unit as claimed in claim 1 wherein said support is a cup-shaped member having a rim secured to the reflector and a base, said holder is a tubular sleeve member centrally disposed in the base of the cup-shaped member, said seal structure being received within the tubular sleeve member and having transverse ribs of said rib and groove means, and said holder having transverse grooves of said rib and groove means and being resilient whereby said grooves snap into engagement with said ribs.

4. A lighting unit as claimed in claim 1 wherein said envelope has a second seal structure at a second end thereof, each of said seal structures comprising a pinch seal with a transverse groove formed therein, and said support has a yoke and two holders carried by said yoke to receive said first and second seal structures, each holder having a rib slidable into engagement with a groove formed in the lamp seal, a base engaging one edge of the seal, a side wall engaging the face of the seal opposite the grooved face, and a folded-over flap attached to the side wall and engaging the other edge of the seal.

* * * * *